US011779800B2

(12) United States Patent
Jiang et al.

(10) Patent No.: US 11,779,800 B2
(45) Date of Patent: Oct. 10, 2023

(54) FOLDABLE TREADMILL

(71) Applicant: BEIJING XIAOMI MOBILE SOFTWARE CO., LTD., Beijing (CN)

(72) Inventors: Junpeng Jiang, Beijing (CN); Yunsong Wang, Beijing (CN); Hui Li, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 134 days.

(21) Appl. No.: 17/586,735

(22) Filed: Jan. 27, 2022

(65) Prior Publication Data

US 2023/0014949 A1 Jan. 19, 2023

(30) Foreign Application Priority Data

Jul. 16, 2021 (CN) ..... 202110806632.7

(51) Int. Cl.
*A63B 22/02* (2006.01)

(52) U.S. Cl.
CPC ..... *A63B 22/0235* (2013.01); *A63B 2210/50* (2013.01)

(58) Field of Classification Search
CPC ..... A63B 22/0235; A63B 2210/50; A63B 2210/56
See application file for complete search history.

(56) References Cited

U.S. PATENT DOCUMENTS 3,685,511 A * 8/1972 Alvarez ..... A61H 15/00 482/144
5,605,526 A * 2/1997 Hatfield ..... A47C 9/002 482/142

(Continued)

FOREIGN PATENT DOCUMENTS

CN 110559606 A 12/2019
WO 2020211386 A1 10/2020

(Continued)

OTHER PUBLICATIONS

Extended European Search Report of EP Application No. 22153844.0 dated Jul. 26, 2022, (49p).

*Primary Examiner* — Garrett K Atkinson
(74) *Attorney, Agent, or Firm* — Arch & Lake LLP

(57) ABSTRACT

A foldable treadmill includes a running belt and a running board module that includes a first running board sub-module and a second running board sub-module symmetrically arranged on both sides of an intermediate running board sub-module. Two groups of folding connection assemblies are symmetrically arranged on both sides of a center line along a width direction of the running belt. A first connection part is coupled to the first running board sub-module and the intermediate running board sub-module, and a second connection part is coupled to the second running board sub-module and the intermediate running board sub-module. A motion part drives the first running board sub-module to rotate relative to the intermediate running board sub-module through the first connection part, and drives the second running board sub-module to rotate relative to the intermediate running board sub-module through the second connection part, to fold or unfold the foldable treadmill.

20 Claims, 4 Drawing Sheets

(56) References Cited

U.S. PATENT DOCUMENTS 5,816,981 A * 10/1998 Hung ..... A63B 22/02 482/54
5,839,993 A * 11/1998 Fox ..... A63B 22/02 482/54
5,897,464 A * 4/1999 Mcleod ..... A63B 23/08 601/27
5,897,474 A * 4/1999 Romero ..... A63B 22/14 482/79
5,931,768 A * 8/1999 Amesquita ..... A63B 23/0211 482/142
6,090,016 A * 7/2000 Kuo ..... A63B 22/02 482/54
6,383,120 B1 * 5/2002 Lo ..... A63B 22/02 482/54
6,421,935 B1 * 7/2002 Bartlett ..... A43B 13/143 482/79
6,857,991 B2 * 2/2005 Yu ..... A63B 22/02 482/54
6,890,287 B2 * 5/2005 Chen ..... A63B 22/02 482/54
6,916,277 B2 * 7/2005 Chen ..... A63B 22/02 482/54
6,979,283 B2 * 12/2005 Pan ..... A63B 22/02 482/54
7,004,887 B2 * 2/2006 Pan ..... A63B 22/02 482/54
7,780,578 B2 * 8/2010 Packham ..... A63B 22/02 482/4
10,589,147 B1 * 3/2020 Kostadis ..... A63B 22/025
2004/0132585 A1 * 7/2004 Chen ..... A63B 22/02 482/54
2006/0149174 A1 * 7/2006 Fink ..... A61H 1/0292 601/134
2008/0103034 A1 * 5/2008 Mihara ..... A63B 26/003 482/146
2008/0234111 A1 * 9/2008 Packham ..... A63B 22/02 482/54
2009/0062072 A1 * 3/2009 Packham ..... A63B 22/02 482/4
2009/0176635 A1 * 7/2009 Brinson ..... A61H 7/001 482/141
2010/0152007 A1 * 6/2010 Le ..... A63B 26/003 482/148
2013/0130872 A1 * 5/2013 Benne ..... A63B 21/4023 482/121
2014/0378283 A1 * 12/2014 Qiu ..... A61H 1/0292 482/142
2020/0215380 A1 * 7/2020 Xing ..... A63B 22/025
2021/0299512 A1 * 9/2021 Kostadis ..... A63B 22/025

FOREIGN PATENT DOCUMENTS

WO WO-2020211386 A1 * 10/2020
WO 2021000857 A1 1/2021

* cited by examiner

FOLDABLE TREADMILL

CROSS-REFERENCE TO RELATED APPLICATIONS

This application is based upon and claims priority to Chinese Patent Application Serial No. 202110806632.7, filed on Jul. 16, 2021, the entire content of which is incorporated herein by reference in its entirety for all purposes.

FIELD

The present disclosure relates to the field of sports equipment and, more particularly, to a foldable treadmill.

BACKGROUND

People tend to be sub-healthy for lack of exercise due to busy work and life. Sub-health is mainly manifested by symptoms such as obesity and cardiopulmonary dysfunction.

Currently, people choose to go to the gym to exercise in order to lose weight and improve their immune system.

However, some people cannot or do not want to go to the gym due to a tight schedule, social phobia or other factors. Running, as one of the easiest exercises, is quite popular among people. Indoor treadmills are the best choice of home fitness equipment, and allow people to run for exercise without leaving home, which satisfies their running requirement.

SUMMARY

A foldable treadmill includes: a running board module including a first running board sub-module, an intermediate running board sub-module, and a second running board sub-module, the first running board sub-module and the second running board sub-module being symmetrically arranged on both sides of the intermediate running board sub-module; a running belt arranged in the running board module; and two groups of folding connection assemblies symmetrically arranged on both sides of a first symmetry axis as a center line of a width direction of the running belt. Each folding connection assembly includes a motion part, a first connection part and a second connection part, the first connection part and the second connection part being coupled to the motion part, the first connection part being coupled to the first running board sub-module and the intermediate running board sub-module, and the second connection part being coupled to the second running board sub-module and the intermediate running board sub-module. The motion part moves between a folded position and an unfolded position, drives the first running board sub-module to rotate relative to the intermediate running board sub-module through the first connection part, and drives the second running board sub-module to rotate relative to the intermediate running board sub-module through the second connection part, to fold or unfold the foldable treadmill.

It is to be understood that the foregoing general description and the following detailed description are exemplary and explanatory only and are not restrictive of the disclosure.

BRIEF DESCRIPTION OF DRAWINGS

The drawings herein are incorporated into the specification and constitute a part of the specification, show examples consistent with the present disclosure, and together with the specification are used to explain the principles of the present disclosure.

DETAILED DESCRIPTION OF EMBODIMENTS

Figure 1:
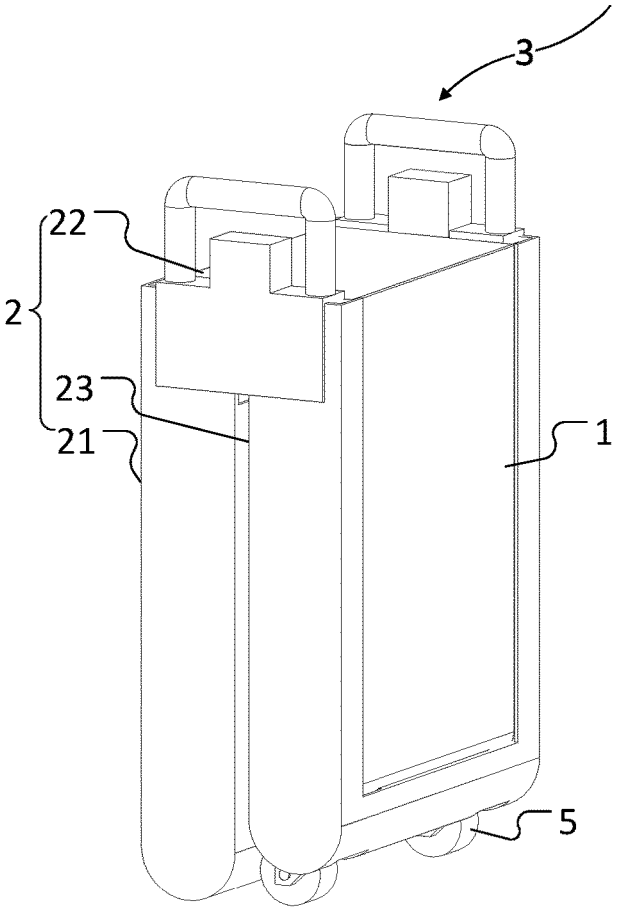
FIG. 1 is a schematic diagram of a foldable treadmill in a folded position according to one or more examples of the present disclosure.

Embodiments will be described in detail, with examples thereof illustrated in the accompanying drawings. The following description refers to the accompanying drawings in which the same numbers in different drawings represent the same or similar elements unless otherwise represented. The implementations set forth in the following description of embodiments do not represent all implementations consistent with the present disclosure. Instead, they are merely examples of devices and methods consistent with some aspects of the present disclosure as recited in the appended claims.

Terms used in the present disclosure are merely for describing specific examples and are not intended to limit the present disclosure. The singular forms "one", "the", and "this" used in the present disclosure and the appended claims are also intended to include a multiple form, unless other meanings are clearly represented in the context. It should also be understood that the term "and/or" used in the present disclosure refers to any or all of possible combinations including one or more associated listed items.

Reference throughout this specification to "one embodiment," "an embodiment," "an example," "some embodiments," "some examples," or similar language means that a particular feature, structure, or characteristic described is included in at least one embodiment or example. Features, structures, elements, or characteristics described in connection with one or some embodiments are also applicable to other embodiments, unless expressly specified otherwise.

It should be understood that although terms "first", "second", "third", and the like are used in the present disclosure to describe various information, the information is not limited to the terms. These terms are merely used to differentiate information of a same type. For example, without departing from the scope of the present disclosure, first information is also referred to as second information, and similarly the second information is also referred to as the first information. Depending on the context, for example, the term "if" used herein may be explained as "when" or "while", or "in response to . . . , it is determined that".

In related art, to solve the problem that treadmills occupy a large area, foldable treadmills have emerged to facilitate storage and save space.

In one example, a foldable treadmill includes a running board, a bracket assembly and a handrail assembly. The bracket assembly can be folded backward around a front portion of the running board. This method reduces the height of the treadmill by folding the handrail assembly. However, the area occupied by the treadmill is not changed, failing to achieve an effect of saving space inside the house.

In another example, a foldable treadmill includes a base, a motor, a running board, and a connection rope. The motor fixed on the base tightens the connection rope fixed on the running board, so that the running board can be set upright and the treadmill can be folded. This method can reduce the area occupied by the treadmill, but the overall height and the high center of gravity of the treadmill leads to poor stability and safety hazards since the treadmill may topple over after being set upright.

The present disclosure proposes a foldable treadmill including a running belt and a running board module, and the running belt is arranged in the running board module. The running board module includes a first running board sub-module, an intermediate running board sub-module, and a second running board sub-module. The first running board sub-module and the second running board sub-module are symmetrically arranged on both sides of the intermediate running board sub-module. With a center line of a width direction of the running belt as a first symmetry axis, the foldable treadmill includes two groups of folding connection assemblies, and the two groups of folding connection assemblies are symmetrically arranged on both sides of the first symmetry axis. The folding connection assembly includes a motion part, as well as a first connection part and a second connection part each coupled to the motion part. The first connection part is coupled to the first running board sub-module and the intermediate running board sub-module, and the second connection part is coupled to the second running board sub-module and the intermediate running board sub-module. The motion part moves between a folded position and an unfolded position, drives the first running board sub-module to rotate relative to the intermediate running board sub-module through the first connection part, and drives the second running board sub-module to rotate relative to the intermediate running board sub-module through the second connection part, to fold or unfold the foldable treadmill. In the present disclosure, the first running board sub-module and the second running board sub-module are arranged on both sides of the intermediate running board sub-module and rotate relative to the intermediate running board sub-module, realizing a three-segment folding and storage effect, stabilizing the center of gravity of the foldable treadmill and preventing the treadmill from toppling over. The overall size of the folded treadmill achieves the effect of low height and small thickness, reducing the occupied area.

Figure 2:
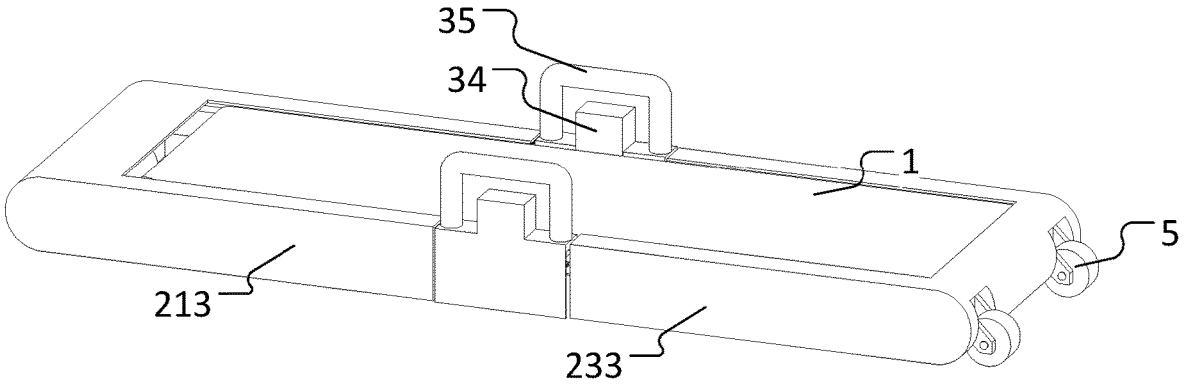
FIG. 2 is a schematic diagram of the foldable treadmill in an unfolded position according to one or more examples of the present disclosure.
Figure 3:
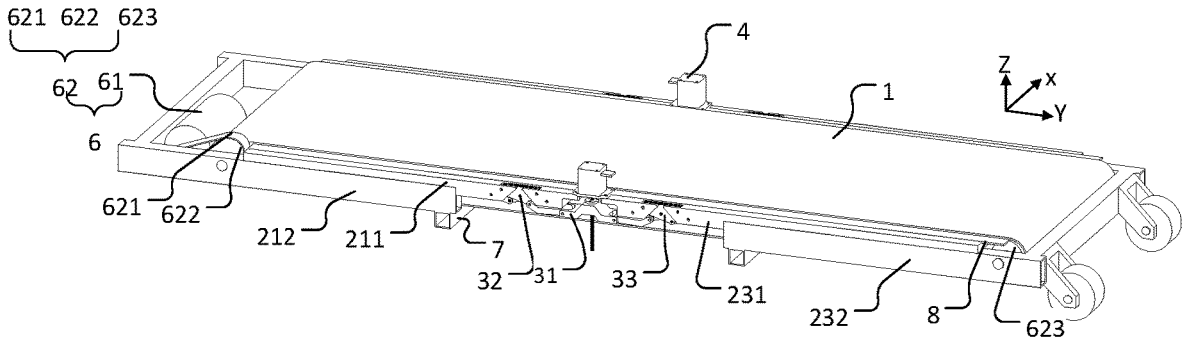
FIG. 3 is a schematic diagram of a running board module in an unfolded position according to one or more examples of the present disclosure.
Figure 4:
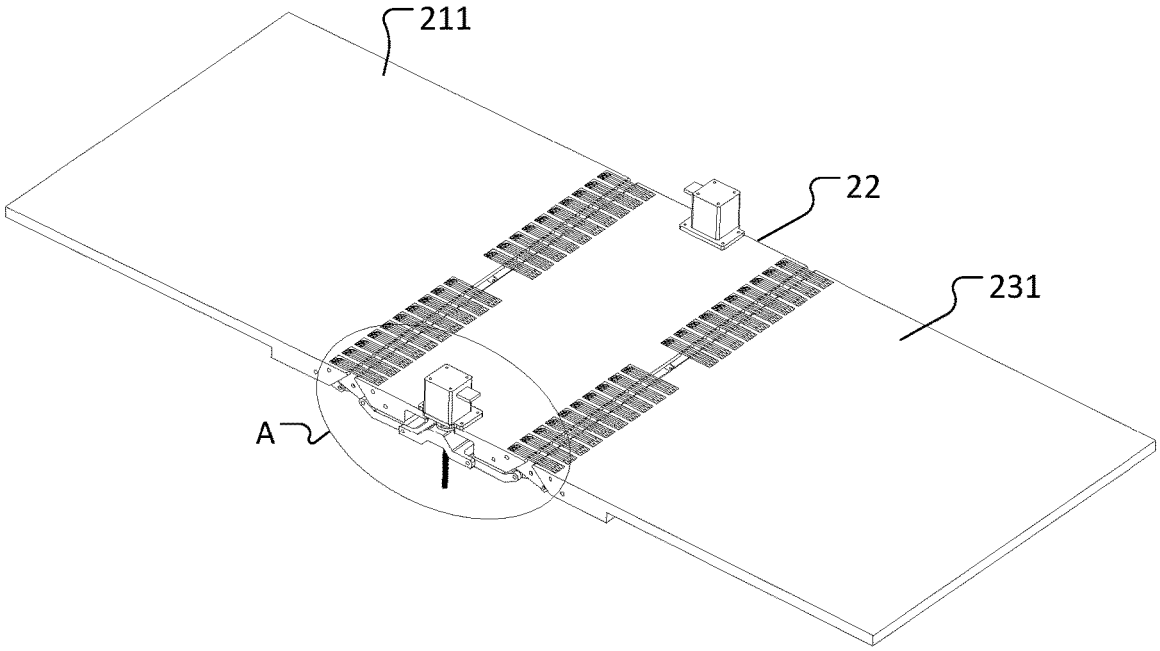
FIG. 4 is a schematic diagram of a running board module in an unfolded position according to one or more examples of the present disclosure.
Figure 5:
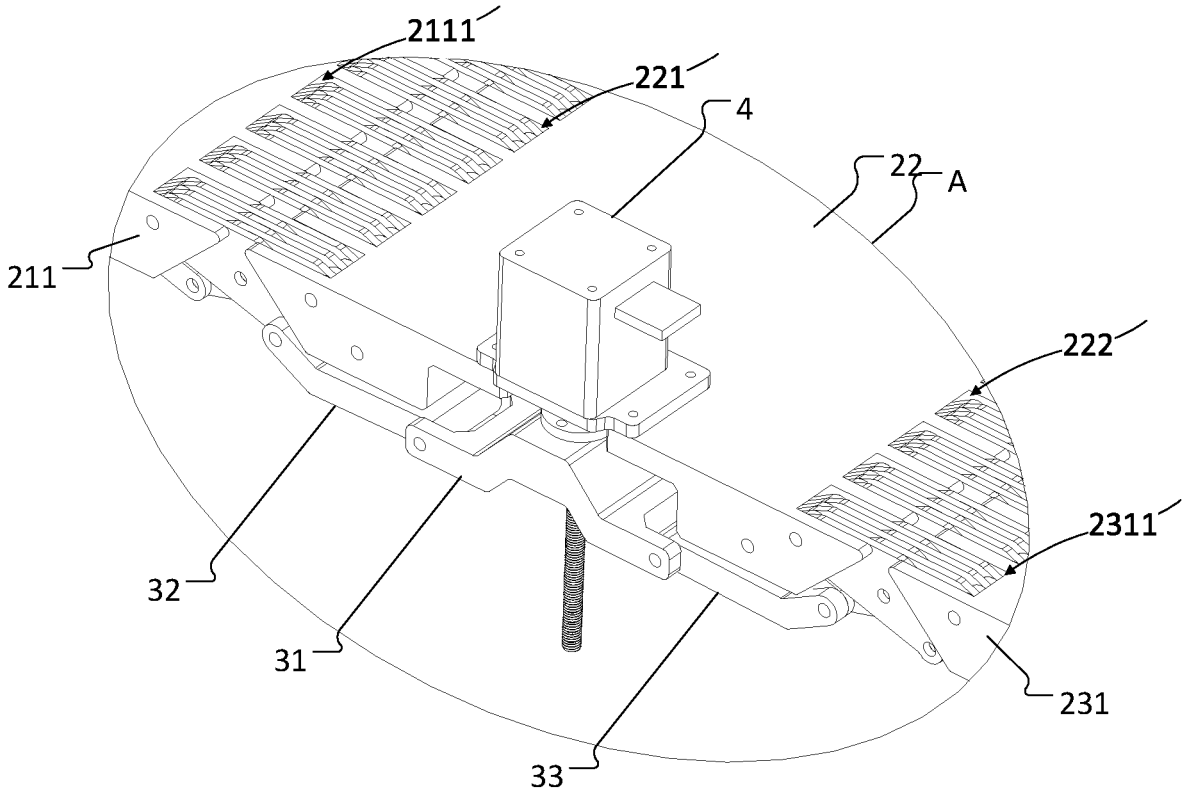
FIG. 5 is a schematic diagram of part A shown in FIG. 4 according to one or more examples of the present disclosure.

In an example, as shown in FIGS. 1-3, the foldable treadmill includes a running belt 1 and a running board module 2, and the running belt 1 is arranged in the running board module 2, realizing the support for the running belt 1 and preventing the running belt 1 from going slack.

The running board module 2 includes a first running board sub-module 21, an intermediate running board sub-module 22, and a second running board sub-module 23, and the first running board sub-module 21 and the second running board sub-module 23 are symmetrically arranged on both sides of the intermediate running board sub-module 22 to realize a three-segment structure of the running board module 2.

With a center line of a width direction of the running belt 1 (refer to an X-axis in FIG. 3) as a first symmetry axis (refer to a Y-axis in FIG. 3), the foldable treadmill includes two groups of folding connection assemblies 3, and the two groups of folding connection assemblies 3 are symmetrically arranged on both sides of the first symmetry axis.

The folding connection assembly 3 includes a motion part 31, a first connection part 32 and a second connection part 33, and the motion part 31 is coupled to the first connection part 32 and the second connection part 33. The first connection part 32 is coupled to the first running board sub-module 21 and the intermediate running board sub-module 22, and the second connection part 33 is coupled to the second running board sub-module 23 and the intermediate running board sub-module 22.

The motion part 31 moves between a folded position and an unfolded position, drives the first running board sub-module 21 to rotate relative to the intermediate running board sub-module 22 through the first connection part 32, and drives the second running board sub-module 23 to rotate relative to the intermediate running board sub-module 22 through the second connection part 33, to fold or unfold the foldable treadmill. When the first running board sub-module 21 and the second running board sub-module 23 rotate towards the intermediate running board sub-module 22 and draw close, the running board module 2 presents an inverted U-shaped structure, which improves the stability of the foldable treadmill, avoids shift of the center of gravity, and ensures that the folded treadmill will not topple over. After the foldable treadmill is folded and stored, its overall size is reduced to avoid taking up too much space at home. Users can place it lying flat or upright as needed to meet the needs of users.

In an example, as shown in FIGS. 3-8, the motion part 31 includes a first motion unit 311, a first transmission unit 312, and a second transmission unit 313. The first motion unit 311 is rotatably coupled to the first transmission unit 312 and the second transmission unit 313. The first transmission unit 312 and the second transmission unit 313 are symmetrically arranged on both sides of the first motion unit 311. The first transmission unit 312 is rotatably coupled to the first connection part 32, and the second transmission unit 313 is rotatably coupled to the second connection part 33.

Figure 6:
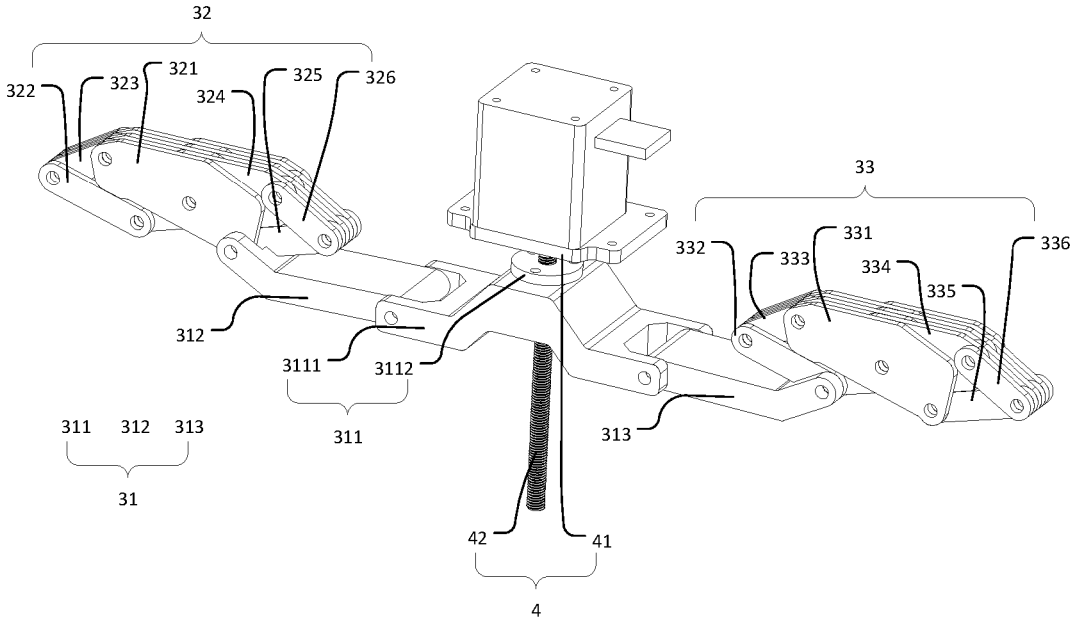
FIG. 6 is a schematic diagram illustrating connection between a folding connection assembly and a first drive part according to one or more examples of the present disclosure.
Figure 7:
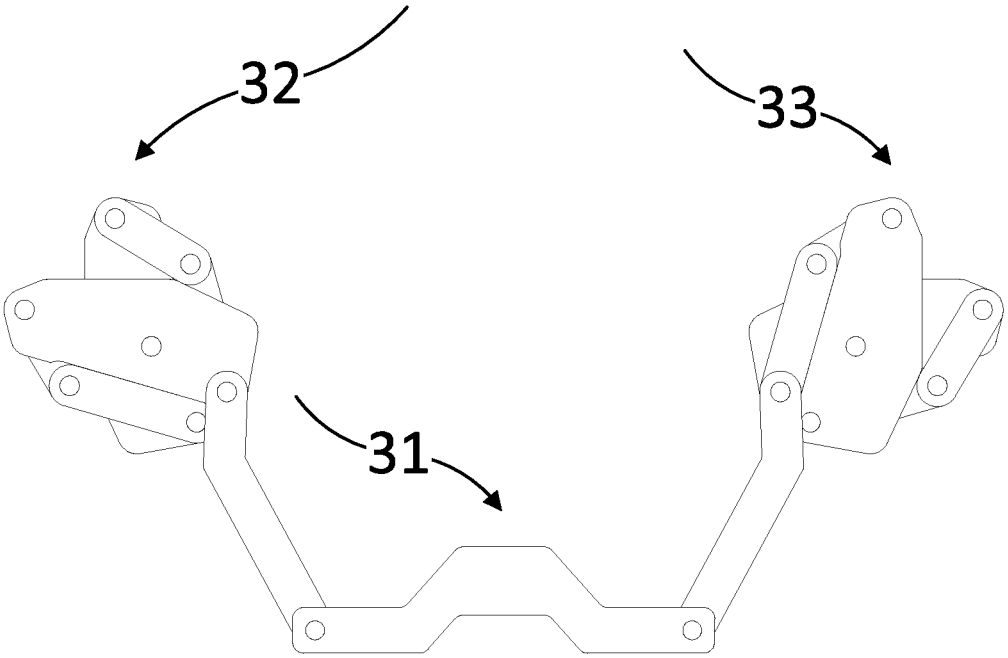
FIG. 7 is a schematic diagram illustrating a first angle between first and second transmission units and a first motion unit, according to one or more examples of the present disclosure.

As shown in FIGS. 6 and 7, the first motion unit 311 moves linearly along a longitudinal direction (referring to a Z-axis shown in FIG. 3). In the folded position, each of the first transmission unit 312 and the second transmission unit 313 forms a first angle relative to the first motion unit 311, in which the first angle may be, for example, from 90° to 150°.

Figure 8:
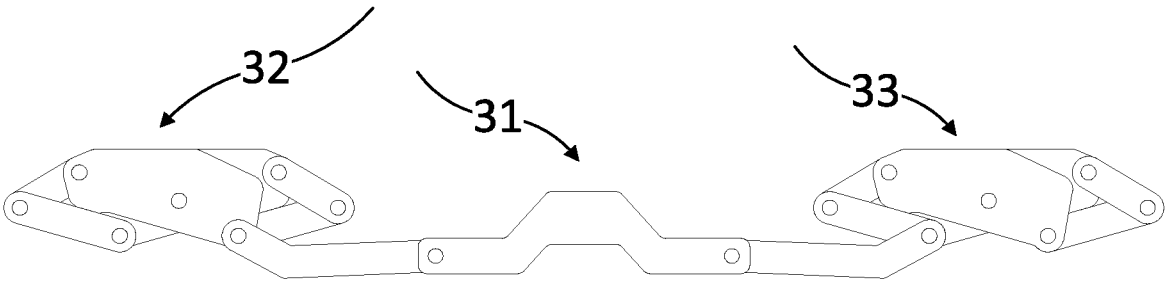
FIG. 8 is a schematic diagram illustrating a second angle between first and second transmission units and a first motion unit, according to one or more examples of the present disclosure.

As shown in FIGS. 6 and 8, in the unfolded position, each of the first transmission unit 312 and the second transmission unit 313 forms a second angle relative to the first motion unit 311, in which the second angle may be, for example, from 150° to 180°.

In this example, the first motion unit 311 includes an H-shaped connection rod 3111, and the first transmission unit 312 and the second transmission unit 313 are arranged at both ends of the H-shaped connection rod 3111, to achieve rotational connection.

In this example, as shown in FIG. 6, the first transmission unit 312 includes a U-shaped connection rod, a first end of the U-shaped connection rod of the first transmission unit 312 may has a first shaft hole, and a first end of the first motion unit 311 has a second shaft hole. The first transmission unit 312 is fitted over a shaft rod structure through the first shaft hole, and the first motion unit 311 is also fitted over the shaft rod structure through the second shaft hole, to realize rotational connection between the first transmission unit 312 and the first motion unit 311. A second end of the U-shaped connection rod of the first transmission unit 312 is rotatably coupled to the first connection part 32 in the same way as the first transmission unit 312 is rotatably coupled to the first motion unit 311, which will not be elaborated herein.

The second transmission unit 313 also includes a U-shaped connection rod, a first end of the U-shaped connection rod of the second transmission unit 313 is rotatably coupled to a second end of the first motion unit 311, and a second end of the U-shaped connection rod is rotatably coupled to the second connection part 33. The rotational connection of the second transmission unit 313 with the first motion unit 311 and the first connection part 32 is realized in the same way as the rotational connection of the first transmission unit 312 with the first motion unit 311 and the second connection part 33, which will not be elaborated herein.

In this example, as shown in FIGS. 3-6, the first connection part 32 includes a four-connection-rod hinge that includes a plurality of connection rods. The plurality of connection rods includes a first connection rod 321 and a second connection rod 322, the first connection rod 321 is longer than the second connection rod 322, and a first end of the first connection rod 321 of the first connection part 32 is rotatably coupled to the first transmission unit 312. The second connection rod 322 and the first connection rod 321 are located in a common plane. During a folding or unfolding action, a side wall of the second connection rod 322 forms face-to-face contact with a side wall of the first connection rod 321, so that the second connection rod 322 and the first connection rod 321 are mutually restrained and constitute a structural limit to avoid excessive movement of the four-connection-rod hinge.

The first connection part 32 is coupled to the first running board sub-module 21, and the plurality of connection rods include, for example, a third connection rod 323, which is shorter than the second connection rod 322 and overlaps with the second connection rod 322 along the width direction of the running belt 1. The third connection rod 323 is fixedly mounted in the first running board sub-module 21. A second end of the first connection rod 321 is rotatably coupled to a first end of the third connection rod 323, a second end of the third connection rod 323 is rotatably coupled to a first end of the second connection rod 322, and the second connection rod 322 and the first connection rod 321 of the first connection part 32 are both coupled to the first running board sub-module 21 through the third connection rod 323.

The first connection part 32 is coupled to the intermediate running board sub-module 22, and the plurality of connection rods include, for example, a first branch connection rod 324, a second branch connection rod 325 and a third branch connection rod 326, the first branch connection rod 324 being longer than the second branch connection rod 325, and the second branch connection rod 325 being longer than the third branch connection rod 326. The first branch connection rod 324 overlaps with the first connection rod 321 along the width direction of the running belt 1, and the second branch connection rod 325 overlaps with the first connection rod 321 along the width direction of the running belt 1. The second branch connection rod 325 and the first branch connection rod 324 are is in a common plane, and the third branch connection rod 326 and the first branch connection rod 324 are in a common plane. The third branch connection rod 326 overlaps with the first branch connection rod 324 and the second branch connection rod 325 along the width direction of the running belt 1. A middle portion of the first branch connection rod 324 is rotatably coupled to a middle portion of the first connection rod 321. A first end of the first branch connection rod 324 is rotatably coupled to a second end of the second connection rod 322, and a second end of the first branch connection rod 324 is rotatably coupled to a first end of the third branch connection rod 326. A second end of the third branch connection rod 326 is rotatably coupled to a first end of the second branch connection rod 325, and a second end of the second branch connection rod 325 is rotatably coupled to the first end of the first connection rod 321. The third branch connection rod 326 is fixedly mounted in the intermediate running board sub-module 22. The first connection rod 321, the second connection rod 322, the third connection rod 323 and the first branch connection rod 324 of the first connection part 32 form a parallelogram linkage, and the first branch connection rod 324, the second branch connection rod 325, the third branch connection rod 326 and the first connection rod 321 also form a parallelogram linkage, in which both linkages share part of the connection rods, so that during rotation the third connection rod 323 and the third branch connection rod 326 tend to approach each other, creating an inward convergence effect.

The first running board sub-module 21 and the intermediate running board sub-module 22 are coupled in sequence by a multi-stage linkage of the first connection part 32, which realizes a linkage effect between the first running board sub-module 21 and the intermediate running board sub-module 22, and the arrangement of the multi-stage linkage improves the stability between the first running board sub-module 21 and the intermediate running board sub-module 22 when they are folded or unfolded.

During the folding or unfolding action, the side wall of the first connection rod 321 of the first connection part 32 forms face-to-face contact with the side wall of the second connection rod 322 and a side wall of the third branch connection rod 326, and a side wall of the first branch connection rod 324 forms face-to-face contact with a side wall of the third connection rod 323 and a side wall of the second branch connection rod 325. As a result, the plurality of connection rods are mutually restrained and constitute structural limits to avoid excessive movement of the four-connection-rod hinge, and enhance the service life of the first connection part 32.

In this example, as shown in FIGS. 3-6, the second connection part 33 also includes a four-connection-rod hinge, and the four-connection-rod hinge includes a plurality of connection rods. The plurality of connection rods includes a first connection rod 331 and a second connection rod 332, the first connection rod 331 is longer than the second connection rod 332, and a first end of the second connection rod 332 of the second connection part 33 is rotatably coupled to the second transmission unit 313. The second connection rod 332 and the first connection rod 331 are located in a common plane. During a folding or unfolding action, a side wall of the second connection rod 332 forms face-to-face contact with a side wall of the first connection rod 331, so that the second connection rod 332 and the first connection rod 331 are mutually restrained and constitute a structural limit to avoid excessive movement of the four-connection-rod hinge.

The second connection part 33 is coupled to the intermediate running board sub-module 22, and the plurality of connection rods include, for example, a third connection rod 333, which is shorter than the second connection rod 332 and overlaps with the second connection rod 332 along the width direction of the running belt 1. The third connection rod 333 is fixedly mounted in the intermediate running board sub-module 22. A second end of the second connection rod 332 is rotatably coupled to a first end of the third connection rod 333, a second end of the third connection rod 333 is rotatably coupled to a first end of the first connection rod 331, and the second connection rod 332 and the first connection rod 331 of the second connection part 33 are both coupled to the intermediate running board sub-module 22 through the third connection rod 333.

The second connection part 33 is coupled to the intermediate running board sub-module 22, and the plurality of connection rods include, for example, a first branch connection rod 334, a second branch connection rod 335 and a third branch connection rod 336, the first branch connection rod 334 being longer than the second branch connection rod 335, and the second branch connection rod 335 being longer than the third branch connection rod 336. The first branch connection rod 334 overlaps with the first connection rod 331 along the width direction of the running belt 1, and the second branch connection rod 335 overlaps with the first connection rod 331 along the width direction of the running belt 1. The second branch connection rod 335 and the first branch connection rod 334 are is in a common plane, and the third branch connection rod 336 and the first branch connection rod 334 are in a common plane. The third branch connection rod 336 overlaps with the first branch connection rod 334 and the second branch connection rod 335 along the width direction of the running belt 1. A middle portion of the first branch connection rod 334 is rotatably coupled to a middle portion of the first connection rod 331. A first end of the first branch connection rod 334 is rotatably coupled to a second end of the second connection rod 332, and a second end of the first branch connection rod 334 is rotatably coupled to a first end of the third branch connection rod 336. A second end of the third branch connection rod 336 is rotatably coupled to a first end of the second branch connection rod 335, and a second end of the second branch connection rod 335 is rotatably coupled to the first end of the first connection rod 331. The third branch connection rod 336 is fixedly mounted in the second running board sub-module 23. The first connection rod 331, the second connection rod 332, the third connection rod 333 and the first branch connection rod 334 of the second connection part 33 form a parallelogram linkage, and the first branch connection rod 334, the second branch connection rod 335, the third branch connection rod 336 and the first connection rod 331 also form a parallelogram linkage, in which both linkages share part of the connection rods, so that during rotation the third connection rod 333 and the third branch connection rod 336 tend to approach each other, creating an inward convergence effect.

The second running board sub-module 23 and the intermediate running board sub-module 22 are coupled in sequence by a multi-stage linkage of the second connection part 33, which realizes a linkage effect between the second running board sub-module 23 and the intermediate running board sub-module 22, and the arrangement of the multi-stage linkage improves the stability between the second running board sub-module 23 and the intermediate running board sub-module 22 when they are folded or unfolded. During the folding or unfolding action, the side wall of the first connection rod 331 of the second connection part 33 forms face-to-face contact with the side wall of the second connection rod 332 and a side wall of the third branch connection rod 336, and a side wall of the first branch connection rod 334 forms face-to-face contact with a side wall of the third connection rod 333 and a side wall of the second branch connection rod 335. As a result, the plurality of connection rods are mutually restrained and constitute structural limits to avoid excessive movement of the four-connection-rod hinge, and enhance the service life of the second connection part 33.

Here, it should be noted that the plurality of connection rods in the first connection part 32 and the plurality of connection rods in the second connection part 33 are coupled to each other by shaft rod structures to achieve the rotational connection, which will not be elaborated herein.

In this example, a top surface of the four-connection-rod hinge and a top surface of a running board of the running board module 2 keep flush in the unfolded position to ensure flatness of a surface of the foldable treadmill after being unfolded and to avoid a feeling of hollowness when a user's feet are stepping on it.

In an example, as shown in FIGS. 3-6, the foldable treadmill further includes a first drive part 4. The first drive part 4 includes a first drive output unit 41 and a first drive transfer unit 42. The first drive output unit 41 is arranged in the intermediate running board sub-module 22, and the first drive output unit 41 is threadedly coupled to the first motion unit 311 through the first drive transfer unit 42. The first drive output unit 41 outputs a driving force to the first drive transfer unit 42, bringing the first drive transfer unit 42 into rotation. The first drive transfer unit 42 is threadedly coupled to the H-shaped connection rod 3111 of the first motion unit 311, and the first motion unit 311 can move on the first drive transfer unit 42 along a longitudinal straight line.

In one example, the first drive output unit 41 includes a first motor that may be a stepper motor. The first drive transfer unit 42 includes a screw fixedly coupled to an output shaft of the first motor, and the screw is a ball screw to enhance the effect of threaded connection. The first motion unit 311 also includes a flange nut 3112 fitted over the screw and fixed to the H-shaped connection rod 3111, and a lower end of the screw can pass through the H-shaped connection rod 3111. When the first motor outputs the driving force, the screw follows the output shaft of the first motor and rotates synchronously, and the flange nut 3112 drives the H-shaped connection rod 3111 to move along the screw.

With the application of the foldable treadmill, the flange nut 3112 will be worn out when the treadmill is continuously folded or unfolded, causing a loosening condition between the flange nut 3112 and the screw, and the treadmill cannot be folded or unfolded smoothly. In such a case, the flange nut 3112 can be directly replaced without need to replace the H-shaped connection rod 3111, which may save costs.

In this example, as shown in FIGS. 1-3, the folding connection assembly 3 also includes a drive housing 34 covering the first drive part 4, and the drive housing 34 is fixedly coupled to the intermediate running board sub-module 22. The drive housing 34 protects the first drive part 4 from being exposed, which may affect the service life of the first drive part 4.

In this example, as shown in FIGS. 1-3, the folding connection assembly 3 also includes a handrail part 35 mounted on the drive housing 34. When the foldable treadmill is folded, the user can apply force to the handrail part 35, which helps the user to carry or move the foldable treadmill to other positions and satisfies the user's needs.

In an example, as shown in FIG. 3, the foldable treadmill also includes a second drive part 6, and the second drive part 6 includes a second drive output unit 61 and a second drive transfer unit 62. The second drive output unit 61 is arranged in the first running board sub-module 21, and the second drive output unit 61 is coupled to the running belt 1 through the second drive transfer unit 62. When the second drive output unit 61 outputs a driving force to the second drive transfer unit 62, the second drive transfer unit 62 can drive the running belt 1.

In one example, the second drive output unit 61 includes a second motor, which may be, for example, a running belt motor. The second drive transfer unit 62 includes a pulley 621, a first pulley shaft 622 and a second pulley shaft 623, and the pulley 621 is fitted over the first pulley shaft 622 and an output shaft of the second motor. The first pulley shaft 622 is rotatably arranged on the first running board sub-module 21, the second pulley shaft 623 is rotatably arranged on the second running board sub-module 23, and the running belt 1 is fitted over the first pulley shaft 622 and the second pulley shaft 623. The second motor transmits the driving force through the output axial pulley 621, the pulley 621 transmits the driving force to the first pulley shaft 622, and the first pulley shaft 622 drives the running belt 1 to move on the running board module 2. Friction between the running belt 1 and the second pulley shaft 623 enables the running belt 1 to drive the second pulley shaft 623 to rotate on the second running board sub-module 23, which ensures the normal operation of the running belt 1.

In this example, as shown in FIGS. 1 and 3, the foldable treadmill also includes two limit parts 7 arranged on the first running board sub-module 21 and the second running board sub-module 23, respectively. The limit parts 7 may be, for example, rod-like beams, and the two limit parts 7 are fixedly coupled to the first running board sub-module 21 and the second running board sub-module 23, respectively. In the unfolded position, the limit parts 7 are located below the first running board sub-module 21 and the second running board sub-module 23 and located on a surface of the running belt 1. In the folded position, the limit parts 7 can press the running belt 1, so that the running belt 1 adheres to the first running board sub-module 21 and the second running board sub-module 23 through the limit parts 7, avoiding slackness of the running belt 1 after the treadmill is folded, ensuring smooth motion of the running belt 1, and enabling the running belt 1 to be stably mounted in the running board module 2.

In this example, as shown in FIGS. 1 and 3, the foldable treadmill also includes a flexible lubrication layer 8 fixedly coupled to the running board module 2 and located between the running board module 2 and the running belt 1. The flexible lubrication layer 8 includes a PET (polyethylene terephthalate) film and soft rubber to enhance the ductility of the flexible lubrication layer 8. The flexible lubrication layer 8 can be bent as the running board module 2 is bent, without producing any deformation in a length direction, which prolongs the service life of the flexible lubrication layer 8.

When the user is running, the running belt 1 achieves low friction sliding on the flexible lubrication layer 8, which improves a motion effect of the running belt 1, prolongs the service life of the running belt 1, and slows down the wear and tear.

In this example, as shown in FIGS. 1 and 2, the foldable treadmill also includes a wheel part 5 arranged in the second running board sub-module 23 and rotatably coupled to the second running board sub-module 23. The wheel part 5 can include two universal wheels to meet multi-directional rotation. When the foldable treadmill implements a folding action, the first running board sub-module 21 has friction with the ground, and the first running board sub-module 21 only rotates, but the second running board sub-module 23 provided with the wheel part 5 gradually approaches the first running board sub-module 21 under the motion of the second connection part 33 until the first running board sub-module 21 and the second running board sub-module 23 are in a parallel state, to complete the folding action of the foldable treadmill, which realizes the automatic folding of the foldable treadmill, saves human resources, saves time and effort, and enhances the user experience.

In an example, as shown in FIGS. 1-3, the first running board sub-module 21 includes a first running board 211, a first bracket 212, and a first casing 213. The first running board 211 is fixedly coupled to the first bracket 212, and the first casing 213 covers the first bracket 212. The first casing 213 covers the first bracket 212, realizing the wrapping of the first bracket 212 to protect the internal structure of the first running board sub-module 21. The first casing 213 can prevent the internal structure from being exposed and prolongs the service life. The first casing 213 may be, for example, a decorative casing to improve the aesthetics of the first running board sub-module 21, and may be made of soft rubber to improve the frictional resistance between the first casing 213 and the ground, so that the first running board sub-module 21 can roll around its front end to further ensure the smooth execution of the folding action. The first casing 213 and the first bracket 212 avoid the first running board 211 to ensure that the running belt 1 can be mounted onto the first running board 211 successfully. The first running board 211 provides support for feet of the user to meet the user's running need. The first running board 211 is fixedly mounted into the first bracket 212, and the first running board 211 is off the ground through the first bracket 212, so that the first running board 211 has a predetermined distance from the ground to avoid contact between the running belt 1 and the ground and to ensure that the running belt 1 can move smoothly when it is arranged on the first running board 211.

The plurality of connection rods of the first connection part 32 are sequentially arranged along a width direction of the first running board 211 (refer to the X-axis in FIG. 1), and the first running board 211 includes a plurality of first avoidance areas 2111, and the first avoidance areas 2111 include through-holes penetrating the first running board 211 along a thickness direction of the first running board 211 (refer to the Z-axis in FIG. 3). The first avoidance areas 2111 are used to avoid the four-connection-rod hinge of the first connection part 32 to ensure that the first connection part 32 can move normally. In the unfolded position, the top surface of the four-connection-rod hinge keeps flush with a top surface of the first running board 211 to ensure flatness of the surface of the folded treadmill after being unfolded.

In this example, as shown in FIGS. 1-3, the second running board sub-module 23 includes a second running board 231, a second bracket 232 and a second casing 233. The second running board 231 is fixedly coupled to the second bracket 232, and the second casing 233 covers the second bracket 232. The second casing 233 covers the second bracket 232 and wraps the second bracket 232, to protect the internal structure of the second running board sub-module 23 and prevent the internal structure of the second running board sub-module 23 from being exposed, which may affect the service life. Moreover, the aesthetics of the second running board sub-module 23 can be improved and the visual effect can be enhanced.

The second casing 233 and the second bracket 232 avoid the second running board 231 to ensure that the running belt 1 can be mounted onto the second running board 231 successfully. The second running board 231 provides support for feet of the user to meet the user's running need. The second running board 231 is fixedly mounted into the second bracket 232, and the second running board 231 is off the ground through the second bracket 232, so that the second running board 231 has a predetermined distance from the ground to avoid contact between the running belt 1 and the ground and to ensure that the running belt 1 can move smoothly when it is arranged on the second running board 231.

The plurality of connection rods of the second connection part 33 are sequentially arranged along a width direction of the second running board 231 (refer to the X-axis in FIG. 3), and the second running board 231 includes a plurality of second avoidance areas 2311, and the second avoidance areas 2311 include through-holes penetrating the second running board 231 along a thickness direction of the second running board 231 (refer to the Z-axis in FIG. 3). The second avoidance areas 2311 are used to avoid the four-connection-rod hinge of the second connection part 33 to ensure that the second connection part 33 can move normally. In the unfolded position, the top surface of the four-connection-rod hinge keeps flush with a top surface of the second running board 231 to ensure flatness of the surface of the folded treadmill after being unfolded.

In this example, as shown in FIGS. 1-3, the intermediate running board sub-module 22 includes an intermediate running board. The intermediate running board sub-module 22 includes a first intermediate avoidance area 221 on a side adjacent to the first running board sub-module 21, and the first intermediate avoidance area 221 and the first avoidance areas 2111 jointly avoid the four-connection-rod hinge of the first connection part 32 to ensure that the first connection part 32 can move normally. The intermediate running board sub-module 22 includes a second intermediate avoidance area 222 on a side adjacent to the second running board sub-module 23, and the second intermediate avoidance area 222 and the second avoidance areas 2311 jointly avoid the four-connection-rod hinge of the second connection part 33 to ensure that the second connection part 33 can move normally. In the unfolded position, the intermediate running board, the first running board 211 and the second running board 231 simultaneously provide landing points for the user to meet the user's running need. The treadmill in this example adopts a three-segment structure, which improves the length of the foldable treadmill, provides a sufficient running area for the user, avoids the running board module 2 from being too narrow, ensures that the user does not fall down from the running board module 2, and improves the safety of the user when running.

The foldable treadmill provided by the present disclosure includes two groups of folding connection assemblies symmetrically arranged in the running board module along the width direction of the running belt, so that both sides of the foldable treadmill can provide force application points for storage to improve the stability of the foldable treadmill when unfolded and folded. In addition, the first drive part drives the first running board sub-module and the second running board sub-module to rotate relative to the intermediate running board sub-module, realizing the automatic storage function of the foldable treadmill, which is convenient, time-saving and energy-saving, meeting the user's requirement and improving the user experience.

When the first running board sub-module and the second running board sub-module draw close, the limit parts press the running belt, which can avoid the slackness of the running belt after folding without changing its appearance. The overall size of the running belt is not increased, and its shape is not changed. The running belt with the flexible lubrication layer for a lubrication effect of the running belt has improved smoothness during motion. The flexible lubrication layer has no elongation and deformation, which increases the service life of the foldable treadmill.

The foldable treadmill forms an inverted U-shaped structure after being folded, which stabilizes the center of gravity of the whole foldable treadmill and prevents the foldable treadmill from toppling over. Moreover, the inward convergence prevents a dirty surface in contact with the ground from being exposed, to enhance the aesthetics of the foldable treadmill.

The foldable treadmill is stored in a substantially rectangular shape, so that its occupation area, height and thickness are reduced to achieve the effect of low height and small thickness. Users can use the wheel part on the second running board sub-module and the handrail on the drive housing to drag it out of its original position and carry it to other places, or move it against the wall, or place it on the ground, or hide it under the bed, which involves great flexibility and meets various storage needs of users.

Other examples of the present disclosure may be conceivable for those skilled in the art after considering the specification and practicing the technical solutions disclosed herein. The present disclosure is intended to cover any variations, uses, or adaptive changes of the present disclosure. These variations, uses, or adaptive changes follow the general principles of the present disclosure and include common knowledge or conventional technical means in the technical field that are not disclosed in the present disclosure. The description and the examples are regarded as exemplary only, and the true scope of the present disclosure are indicated by the following claims.

It should be understood that the present disclosure is not limited to the particular structures described above and shown in the drawings, and various modifications and changes can be made without departing from the scope of the present disclosure. The scope of the present disclosure is only limited by the appended claims.

The invention claimed is:

1. A foldable treadmill, comprising:

a running board module comprising a first running board sub-module, an intermediate running board sub-module, and a second running board sub-module, the first running board sub-module and the second running board sub-module being symmetrically arranged on both sides of the intermediate running board sub-module;

a running belt arranged in the running board module; and two groups of folding connection assemblies symmetrically arranged on both sides of a first symmetry axis, wherein the first symmetry axis is a center line along a width direction of the running belt, wherein:

each folding connection assembly comprises a motion part, a first connection part, and a second connection part, the first connection part and the second connection part being coupled to the motion part, the first connection part being coupled to the first running board sub-module and the intermediate running board sub-module, and the second connection part being coupled to the second running board sub-module and the intermediate running board sub-module;

the motion part moves between a folded position and an unfolded position, drives the first running board sub-module to rotate relative to the intermediate running board sub-module through the first connection part, and drives the second running board sub-module to rotate relative to the intermediate running board sub-module through the second connection part, to fold or unfold the foldable treadmill.

2. The foldable treadmill according to claim 1, wherein:

the motion part comprises a first motion unit, a first transmission unit and a second transmission unit, the first transmission unit and the second transmission unit being rotatably coupled to the first motion unit and being symmetrically arranged on both sides of the first motion unit, the first transmission unit being rotatably coupled to the first connection part, and the second transmission unit being rotatably coupled to the second connection part;

the first motion unit moves linearly along a longitudinal direction;

in the folded position, each of the first transmission unit and the second transmission unit forms a first angle relative to the first motion unit; and in the unfolded position, each of the first transmission unit and the second transmission unit forms a second angle relative to the first motion unit.

3. The foldable treadmill according to claim 2, wherein the first motion unit comprises an H-shaped connection rod, or each of the first transmission unit and the second transmission unit comprises a U-shaped connection rod.

4. The foldable treadmill according to claim 2, wherein:

each of the first connection part and the second connection part comprises a four-connection-rod hinge, and the four-connection-rod hinge comprises a plurality of connection rods;

the plurality of connection rods comprise a first connection rod and a second connection rod, the first connection rod being longer than the second connection rod; and the first connection rod of the first connection part is rotatably coupled to the first transmission unit, and the second connection rod of the second connection part is rotatably coupled to the second transmission unit.

5. The foldable treadmill according to claim 4, wherein a top surface of the four-connection-rod hinge and a top surface of a running board of the running board keep flush in the unfolded position.

6. The foldable treadmill according to claim 4, wherein:

the plurality of connection rods of each of the first connection part and the second connection part further comprise a third connection rod; and the third connection rod is shorter than the second connection rod and overlaps with the second connection rod along the width direction of the running belt.

7. The foldable treadmill according to claim 4, wherein:

the plurality of connection rods of each of the first connection part and the second connection part further comprise a first branch connection rod, a second branch connection rod and a third branch connection rod, the first branch connection rod being longer than the second branch connection rod, and the second branch connection rod being longer than the third branch connection rod; and the first branch connection rod overlaps with the first connection rod along the width direction of the running belt, the second branch connection rod overlaps with the first connection rod along the width direction of the running belt, and the third branch connection rod overlaps with the first branch connection rod and the second branch connection rod along the width direction of the running belt.

8. The foldable treadmill according to claim 2, further comprising a first drive part, wherein:

the first drive part comprises a first drive output unit and a first drive transfer unit, the first drive output unit is arranged in the intermediate running board sub-module, and the first drive output unit is threadedly coupled to the first motion unit through the first drive transfer unit.

9. The foldable treadmill according to claim 8, wherein the first drive output unit comprises a first motor, the first drive transfer unit comprises a screw coupled to the first motor, and the first motion unit further comprises a flange nut fitted over the screw.

10. The foldable treadmill according to claim 8, wherein the folding connection assembly further comprises a drive housing covering the first drive part, and the drive housing is fixedly coupled to the intermediate running board sub-module.

11. The foldable treadmill according to claim 10, wherein the folding connection assembly further comprises a handrail part mounted on the drive housing.

12. The foldable treadmill according to claim 1, further comprising a second drive part, wherein the second drive part comprises a second drive output unit and a second drive transfer unit, the second drive output unit is arranged in the first running board sub-module, and the second drive output unit is coupled to the running belt through the second drive transfer unit.

13. The foldable treadmill according to claim 12, wherein:

the second drive output unit comprises a second motor;

the second drive transfer unit comprises a pulley, a first pulley shaft, and a second pulley shaft;

the pulley is fitted over the first pulley shaft and an output shaft of the second motor; and the first pulley shaft is arranged in the first running board sub-module, the second pulley shaft is arranged in the second running board sub-module, and the running belt is fitted over the first pulley shaft and the second pulley shaft.

14. The foldable treadmill according to claim 1, further comprising two limit parts arranged in the first running board sub-module and the second running board sub-module correspondingly, wherein the running belt adheres to the first running board sub-module and the second running board sub-module through the limit parts in the folded position.

15. The foldable treadmill according to claim 1, further comprising a flexible lubrication layer fixedly coupled to the running board module and arranged between the running board module and the running belt.

16. The foldable treadmill according to claim 1, further comprising a wheel part arranged in the second running board sub-module and rotatably coupled to the second running board sub-module.

17. The foldable treadmill according to claim 1, wherein the first running board sub-module comprises:

a first running board;

a first bracket fixedly coupled to the first running board; and a first casing covering the first bracket.

18. The foldable treadmill according to claim 17, wherein the first running board comprises a plurality of first avoidance areas, and the first avoidance areas comprise through-holes penetrating the first running board along a thickness direction of the first running board.

19. The foldable treadmill according to claim 1, wherein the second running board sub-module comprises:

a second running board;

a second bracket fixedly coupled to the second running board; and a second casing covering the second bracket.

20. The foldable treadmill according to claim 19, wherein the second running board comprises a plurality of second avoidance areas, and the second avoidance areas comprise through-holes penetrating the second running board along a thickness direction of the second running board.

* * * * *